US005784079A

United States Patent [19]

Masuda et al.

[11] Patent Number: 5,784,079

[45] Date of Patent: Jul. 21, 1998

[54] INK JET HEAD AND INK JET APPARATUS ON WHICH THE INK JET HEAD IS MOUNTED

[75] Inventors: Kazuaki Masuda, Kawasaki; Masami Kasamoto, Ayase; Minoru Nozawa, Yokohama; Eiichiro Shimizu, Urawa; Jun Kawai, Tokyo; Teruo Arashima, Kawasaki; Yuji Kamiyama, Fujisawa, all of Japan

[73] Assignee: Canon Kabushiki Kaisha, Tokyo, Japan

[21] Appl. No.: 496,156

[22] Filed: Jun. 28, 1995

[30] Foreign Application Priority Data

| | | | |
|---|---|---|---|
| Jun. 30, 1994 | [JP] | Japan | 6-148860 |
| Sep. 20, 1994 | [JP] | Japan | 6-224577 |

[51] Int. Cl.[6] ..... B41J 2/15

[52] U.S. Cl. ..... 347/20

[58] Field of Search ..... 347/20, 44, 47

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,418,354 | 11/1983 | Perduijn | 346/140 R |
| 4,459,600 | 7/1984 | Sato et al. | 346/140 R |
| 4,463,359 | 7/1984 | Ayata et al. | 346/1.1 |
| 4,528,575 | 7/1985 | Matsuda et al. | 346/140 R |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,725,851 | 2/1988 | Sutera et al. | 346/75 |
| 4,740,796 | 4/1988 | Endo et al. | 346/1.1 |
| 4,779,099 | 10/1988 | Lewis | 346/1.1 |
| 5,095,321 | 3/1992 | Saito et al. | 346/140 R |
| 5,208,604 | 5/1993 | Watanabe et al. | 346/1.1 |
| 5,262,802 | 11/1993 | Karita et al. | 346/140 R |
| 5,365,255 | 11/1994 | Inoue et al. | 347/45 |
| 5,389,957 | 2/1995 | Kimura et al. | 347/20 |
| 5,436,649 | 7/1995 | Nakagomi et al. | 347/20 |
| 5,548,894 | 8/1996 | Muto | 29/890.1 |

FOREIGN PATENT DOCUMENTS

| | | |
|---|---|---|
| 0419180 | 3/1991 | European Pat. Off. . |
| 0509491 | 10/1992 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |
| 62-42852 | 2/1987 | Japan . |
| 3-101955 | 4/1991 | Japan . |

*Primary Examiner*—Safet Metjahic
*Assistant Examiner*—John Chizmar
*Attorney, Agent, or Firm*—Fitzpatrick, Cella, Harper & Scinto

[57] ABSTRACT

An ink jet head has a substrate on which ejection energy generating elements are provided, and a ceiling plate having a plurality of grooves for forming ink passages. The ceiling plate is pressed against the substrate by a pressing member, i.e., a spring. To improve the ejection performance of the ink jet head, the contact portion of the ceiling plate pressed by the pressing member is divided into a plurality of portions.

18 Claims, 16 Drawing Sheets

FIG. 2

| NUMBER OF GROOVES | PRINTING QUALITY (n=10) | COMMON CONDITION |
|---|---|---|
| 1 | △ ○ △ △ △<br>○ ○ ○ △ △ | SPRING LOAD 1.0kg<br>DEPTH OF GROOVE 30% (SIZE RATIO) |
| 2 | ○ △ ○ ○ ○<br>○ ○ △ ○ △ | SPRING LOAD 1.0kg<br>DEPTH OF GROOVE 30% (SIZE RATIO) |
| 3 | ○ ○ ○ ○ ○<br>△ ○ ○ ○ ○ | SPRING LOAD 1.0kg<br>DEPTH OF GROOVE 30% (SIZE RATIO) |
| 4 | ○ ○ ○ ○ ○<br>○ ○ ○ ○ ○ | SPRING LOAD 1.0kg<br>DEPTH OF GROOVE 30% (SIZE RATIO) |
| 5 | ○ ○ ○ ○ ○<br>○ ○ ○ ○ ○ | SPRING LOAD 1.0kg<br>DEPTH OF GROOVE 30% (SIZE RATIO) |
| COMPATATIVE EXAMPLE 0 | × × △ × ×<br>△ × × × × | SPRING LOAD 1.0kg<br>(NO GROOVE) |

INK JET HEAD AND INK JET APPARATUS ON WHICH THE INK JET HEAD IS MOUNTED

BACKGROUND OF THE INVENTION

1. Field of the Invention

The present invention relates to an ink jet head in which a first base member and a second base member are combined or joined to form ink passages.

The present invention also relates to an ink jet head cartridge in which an ink jet head for ejecting ink by receiving a recording signal and an ink tank for supplying ink to the ink jet head are integrally constructed.

The present invention further relates to an ink jet recording apparatus on which an ink jet cartridge is mounted and which performs desired recording.

2. Description of the Related Art

An ink jet recording system is arranged to perform desired recording in such a manner that an ink droplet is caused to fly out of a fine ejection port provided in a recording head so that the ink droplet is attached to a surface of a recording medium sheet.

FIG. 10 is a schematic perspective view of a portion of an ink jet head used in the above-described ink jet recording system.

A member 1 shown in FIG. 10 is a substrate on which a plurality of ejection energy generating elements, e.g., electrothermal transducers (not shown) are arranged. A member 2 is a grooved ceiling plate in which are integrally formed a plurality of grooves 7*a* for forming ink ejection ports 9 and ink passages 7 communicating with the ink ejection ports 9, wall portions 7*b* forming ink passage walls, and a cavity for forming a common liquid chamber (not shown) for supplying ink to the ink passages 7. A member 3 is a supporting member made of aluminum, on which parts of the head are assembled. A member 4 is a spring plate member, i.e., a means for combining the substrate and the grooved ceiling plate 2 by mechanically maintaining adhesion therebetween to form the ink passages 7.

The spring plate member 4 has a generally C-like cross-section and pinches and presses the substrate 1 and the grooved ceiling plate 2 from above and below as viewed in FIG. 10 to combine these members. The spring plate member 4 applies the pressing force for combining the substrate 1 and the grooved ceiling plate 2 to the upper surface of the grooved ceiling plate 2 through its portion contacting the upper surface of the ceiling plate 2.

The inventors of the present invention have also proposed, as a method for combining members in such a manner, a method of bending end portions of a plate spring to form linear end surfaces with which a second substrate is pressed (Japanese Patent Laid-Open Publication No. 101955/1991). This method is illustrated in FIGS. 11(*a*) and 11(*b*).

Referring to FIGS. 11(*a*) and 11(*b*), a spring plate member 4 has a generally C-like cross section and has a flat plane portion 4*c* generally parallel to the upper surface of a grooved ceiling plate 2 and side portions 4*d* extending along side surfaces of a substrate 1 and a grooved ceiling plate 2 forming a joint. Arm portions 4*d* engaged with a supporting plate 3 to cause a pressing force of the spring plate member 4 are provided on the side portions 4*d*. Further, the spring plate member 4 has a line pressure generating portion 6 which extends from the flat portion 4*c* and which is bent to contact the ceiling plate upper 2 surface side. The line pressure generating portion 6 applies a pressure to the substrate 1 and the grooved ceiling plate 2 along a line to combine these members. The stress of the pressing force is thereby concentrated, so that the pressing force is applied uniformly, thereby combining the members firmly and reliably.

It has been disclosed that such a method ensures sufficiently high adhesion between the first base member (substrate) having an ejection pressure generating portion and the second base member (grooved ceiling plate) having grooves for forming liquid passages and, therefore, enables high-quality printing without crosstalk.

It has actually been confirmed that, by the above-described method, sufficiently high printing qualities can be achieved with respect to grooved ceiling plates having 50 to 100 flow passages. However, a test of a head having a second base member designed to increase the printing speed by using about 150 flow passages has also been made, and the result of this test is that the adhesion between the substrate and the grooved ceiling plate is insufficient and a gap is therefore formed therebetween to cause crosstalk between ink passages, resulting in a considerable deterioration in printing quality. This may be because warping or deformation of the grooved ceiling plate caused at the time of molding is increased due to the increase in the size of the grooved ceiling plate to such an extent that the desired adhesion to the substrate cannot be attained by the pressing force of the spring. A trial has been made to solve this problem by increasing the pressing force of the spring to find that an improvement in adhesion by a small increase the spring pressing force is insufficient. It is undesirable to increase the spring pressure because a risk of breakage of the substrate caused by the arm portions 4*e* arises with an increase in the spring pressure.

SUMMARY OF THE INVENTION

In view of these circumstances, an object of the present invention is to provide an ink jet head in which the desired uniformity and reliability of the pressing force with which the pressing member 4 presses and combines the substrate 1 and the grooved ceiling plate 2 are maintained or compensated to achieve high-quality recording.

Another object of the present invention is to provide an ink jet head cartridge in which a recording head having the above-mentioned improved characteristic and an ink tank for supplying ink to the recording head are integrally provided, and which is interchangeably attached to an ink jet apparatus.

Still another object of the present invention is to provide an ink jet apparatus in which an ink jet head cartridge using an ink jet head having the above-mentioned improved characteristic is mounted to perform recording.

The inventors of the present invention have made thorough studies to achieve the above-described objects and have found with respect to the grooved ceiling plate that sufficiently high adhesion between the ceiling plate and the substrate can be achieved if the portion of the ceiling plate which contacts a spring when pressed by the same is divided into a plurality of portions. This means enables the grooved ceiling plate to deform easily when a pressure is applied to the grooved ceiling plate by a spring, and thereby ensures that the adhesion to the substrate can be improved even if the grooved ceiling plate has some warping or deformation.

BRIEF DESCRIPTION OF THE DRAWINGS

FIG. 1(*b*) is a cross-sectional view of FIG. 1(*a*);

FIG. 2 is a table showing the effect of the present invention;

DESCRIPTION OF THE PREFERRED EMBODIMENTS

Figure 1A:
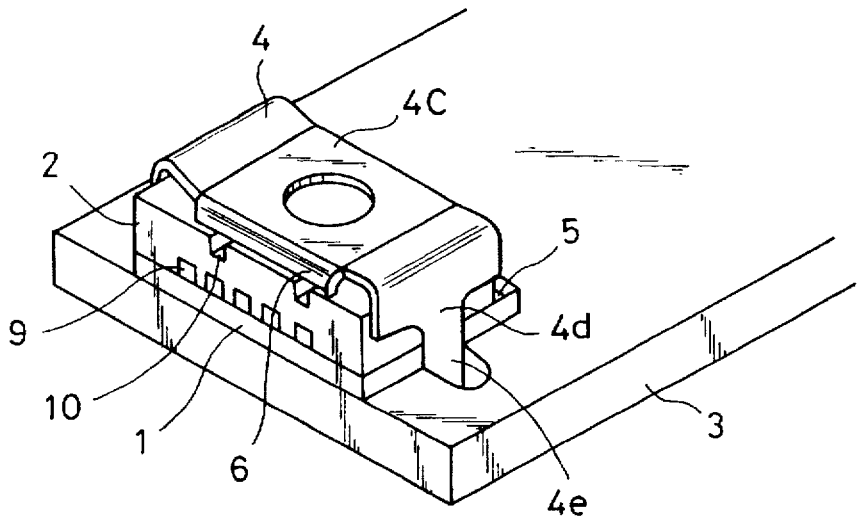
FIG. 1(*a*) is a schematic perspective view of an example of an ink jet recording head in accordance with the present invention.
Figure 1B:
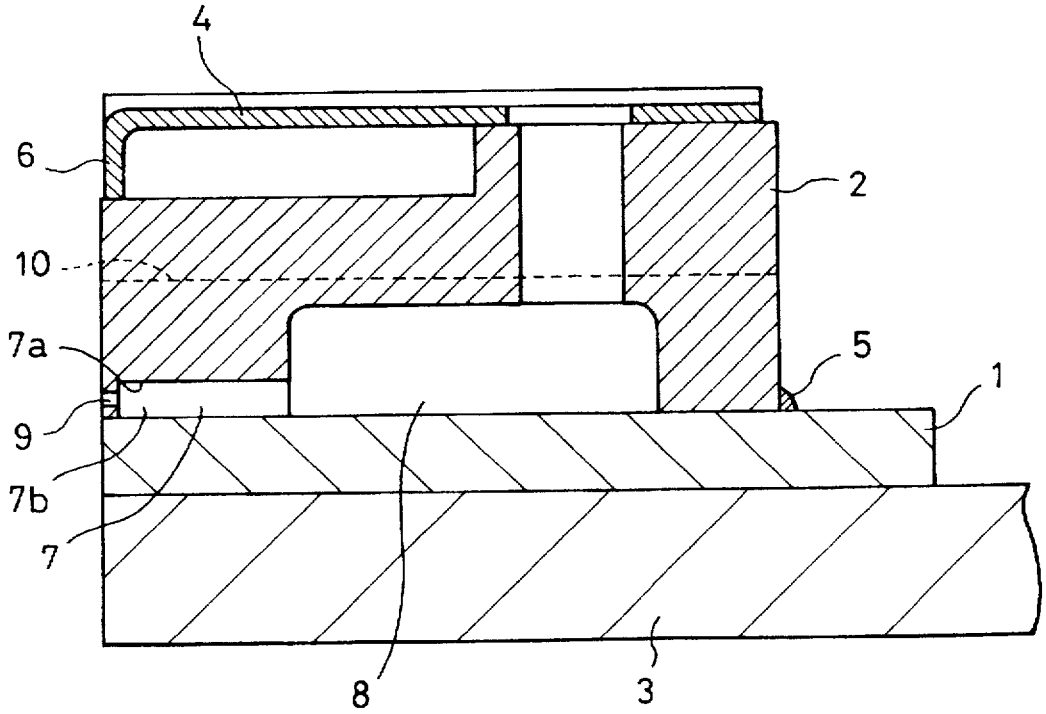

Preferred embodiments of the present invention will be described below with reference to the drawings. The description for the embodiments will be made by assuming that the liquid used is ink. However, any other liquid may be used as long as it can be ejected in accordance with the principle of the present invention. FIGS. 1(*a*) and 1(*b*) are a schematic exploded perspective view and a schematic cross-sectional view, respectively, of a portion of an ink jet head in accordance with the present invention. A member 1 is a substrate (first base member) which has a plurality of ejection energy generating elements, i.e., electrothermal transducers in this embodiment, and which is mainly formed of silicon. A member 2 is a grooved ceiling plate (second base member) having a multiplicity of grooves 7*a* for forming ejection ports 9 and flow passages (ink passages) 7, wall portions 7*b* forming ink channel walls, and a cavity for forming a common ink chamber 8 in which ink to be supplied to each ink passage is stored. The grooved ceiling plate 2 is formed from molded resin. A member 3 is an aluminum plate provided as a supporting member on which parts are assembled to construct the head. A member 4 is a pressing member for mechanically maintaining adhesion between the substrate 1 and the grooved ceiling plate 2 to form the ink passages 7 and the common ink chamber 8. In this embodiment, the spring plate member is made of, for example, a metal such as phosphor bronze or a spring stainless steel, fiber reinforced plastic (FRP) or the like, and is used as the pressing member 4. An adhesive 5 is provided to temporarily fix the substrate 1 and the grooved ceiling plate to each other. The adhesive 5 is a photo-curing type adhesive.

In the grooved ceiling plate 2 in accordance with the present invention, grooves 10 (two grooves 10 are used in the example shown) are formed in the upper surface (the surface to be brought into contact with the pressing member) so as to extend in a direction intersecting (most preferably, perpendicular to) the direction in which the ink passages are arranged.

As the head of this embodiment, five groups of heads each of which consists of ten heads each having 128 ejection ports 9 (represented by only five for ease of illustration) and which vary in the number of grooves 10 from 1 to 5 were manufactured and assembled to be each completed as a head, and were tested with respect to printing qualities. The spring used was made of phosphor bronze and had a load of about 1.0 kg. The depth of grooves 10 was about 30% of the size of the grooved ceiling plate 2 in a direction perpendicular to the surface of the ceiling plate 2 in contact with the substrate 1. FIG. 2 shows the result of this test. The result of a test of other heads provided as a comparative example in which no grooves 10 were formed is also shown in FIG. 2.

As shown in FIG. 2, in eight heads among the ten comparative example heads were unsatisfactory in printing quality and had crosstalk between adjacent nozzles. In contrast, apparent improvements in quality were recognized with respect to the heads having grooves 10. In particular, in the group in which the number of grooves 10 was 4 or 5, all of the ten heads exhibited very good printing qualities.

Figure 3:
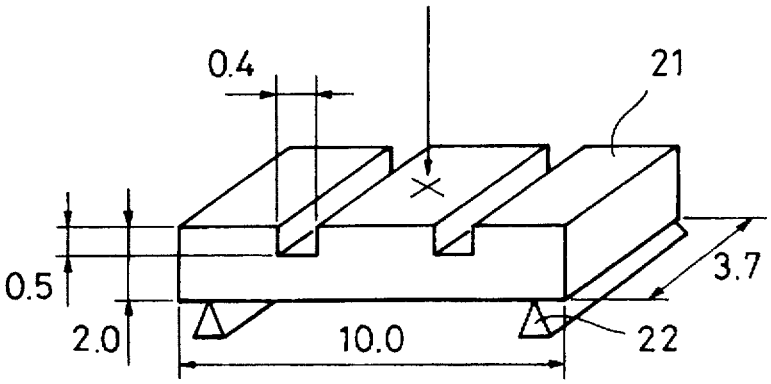
FIG. 3 is a diagram for explaining the effect of the present invention.
Figure 4:
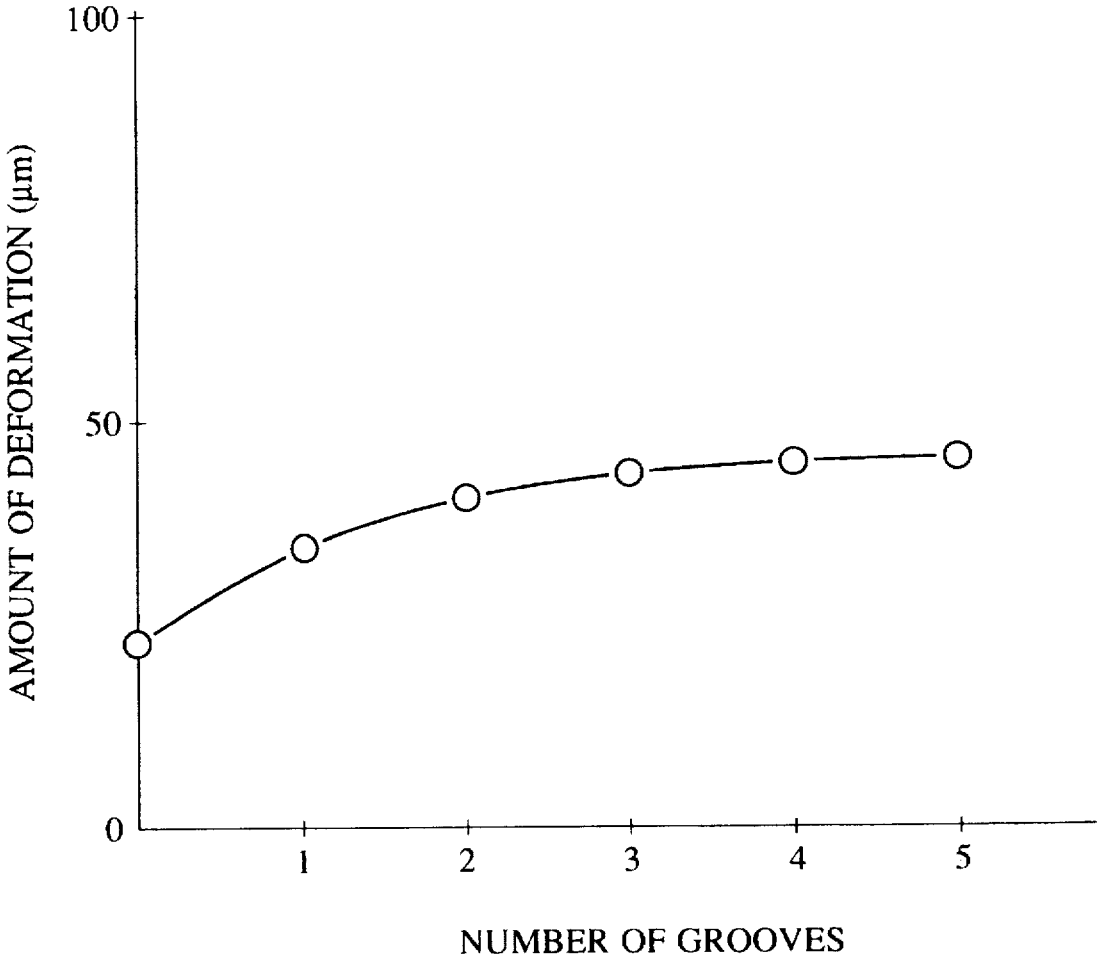
FIG. 4 is a graph showing the effect of the present invention.

The result was that the printing quality becomes higher as the number of grooves increases. This directly means improvements in adhesion between the substrate and the grooved ceiling plate. That is, it is thought that, if the number of grooves is increased, the grooved ceiling plate can deform more easily so that the adhesion becomes higher with respect to a constant spring load applied to the grooved ceiling plate. To substantiate this experimental result, the inventors made a simplified experimental model as shown in FIGS. 3 and 4. Referring to FIG. 3, a block 21 was formed of the same material as the above-described grooved ceiling plate (polysulfone, in this case), and grooves are formed as grooves 10 in this block (represented by two grooves in the illustration). Two ends of this block were fixed (as indicated at 22), a load was imposed at the center between the two ends and the amount of deformation (warp) of the block was measured. FIG. 4 shows the result of this experiment. It can be understood that, as is apparent from FIG. 4, the amount of deformation becomes larger so that the block is easier to deform by the load if the number of grooves is increased.

Figure 5:
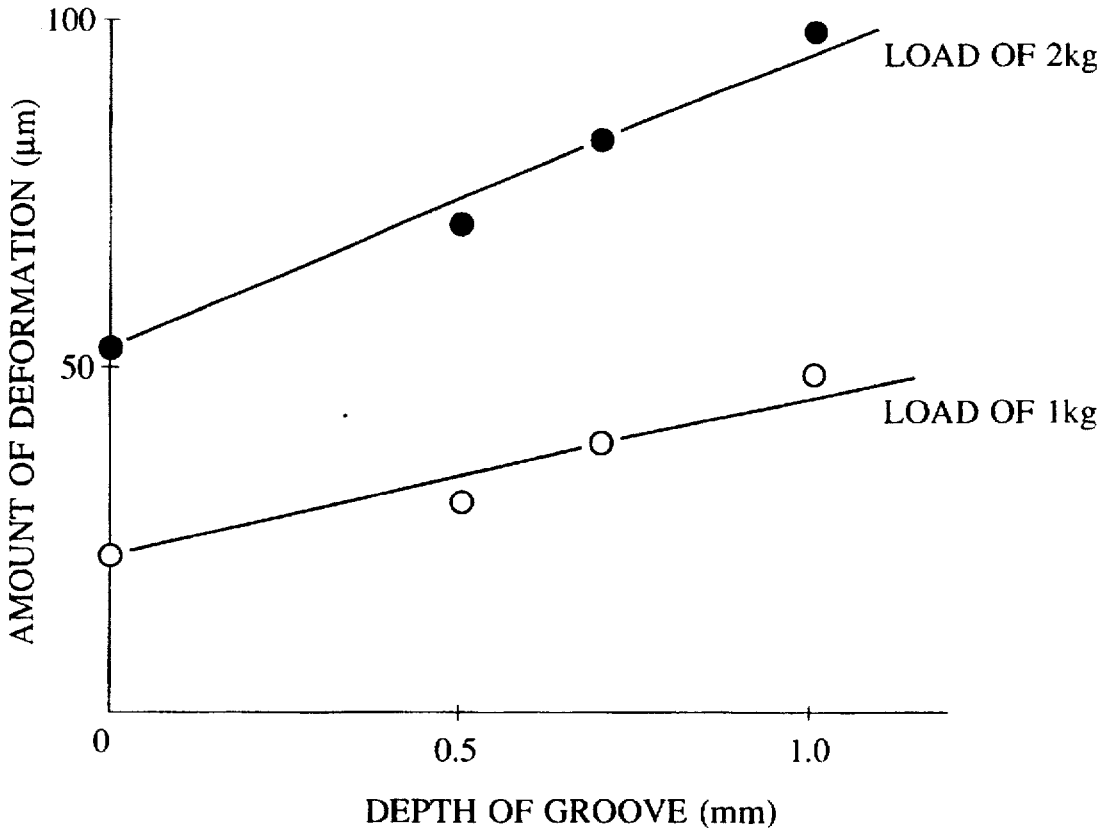
FIG. 5 is a graph showing the effect of the present invention.
Figure 6:
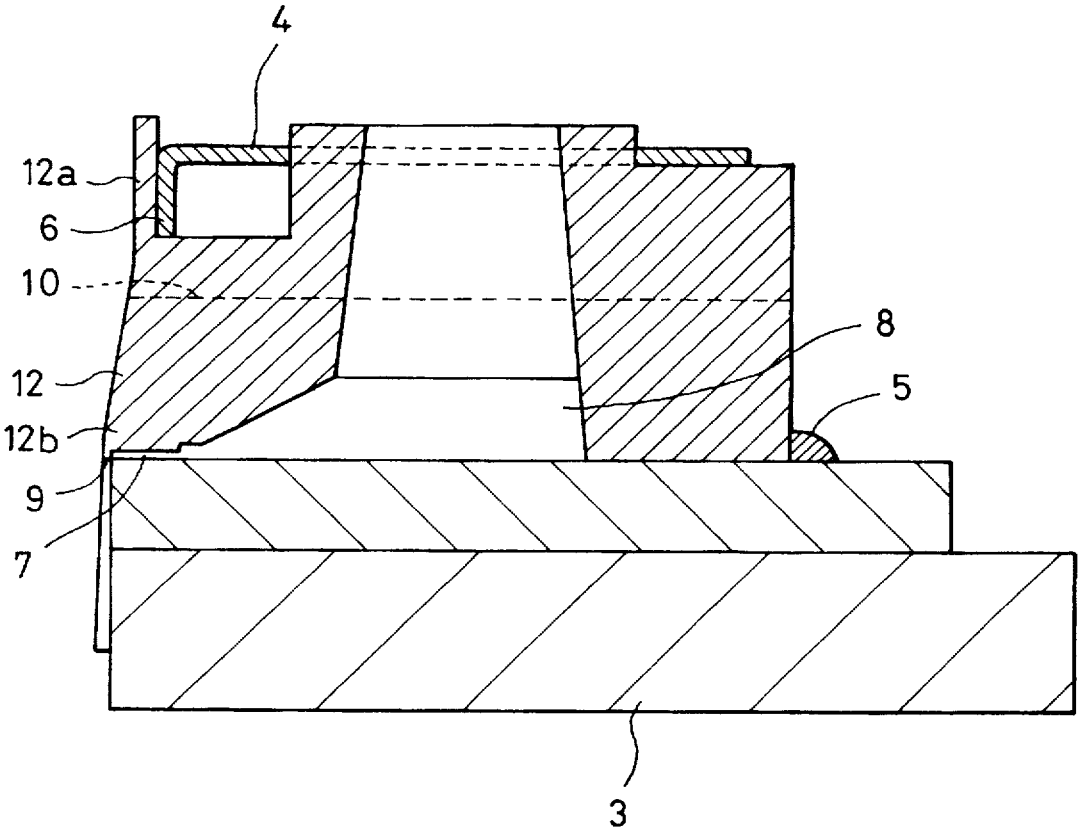
FIG. 6 is a diagram of another example of the present invention.

In relation to this, FIG. 5 shows the amount of deformation with respect to changes in the depth of grooves in a similar model test. In this case, the number of grooves was set at two while the depth of the grooves was changed. The load was set to 1 kg and 2 kg. Naturally, as is apparent from FIG. 5, the groove amount of deformation increases if the depth becomes larger.

As described above, in improving the adhesion between the substrate and the grooved ceiling plate to obtain good printing qualities free from crosstalk while the spring load is kept constant, it is effective to form grooves in the grooved ceiling plate so that the ceiling plate is easier to deform. The selection of the number of grooves and depth is a design theme with respect to products to which the invention is applied. Optimal values of the strength of the usable spring, the warp of the grooved ceiling plate and the flowability at the time of molding of the resin for forming the grooved ceiling plate, which are possible under design restrictions, may be selected.

(Second Embodiment)

The present invention will be described in further detail with respect to a second embodiment thereof with reference to FIG. 12, which is a schematic exploded perspective view of a portion of an ink jet head which represents the second embodiment of the present invention. An element substrate (heater board) 112 has a plurality of ejection energy generating elements (electrothermal transducers in this embodiment) and is mainly formed of silicon. A grooved member 113 (ceiling plate) has a plurality of grooves for forming ejection ports and flow passages, wall portions forming ink channel walls, and a cavity for forming a common ink chamber in which ink to be supplied to each ink passage is stored. The grooved ceiling plate 113 is formed from molded resin. A base plate 111 is provided as a supporting member on which parts are assembled to construct the head. A pressing member 114 is provided to mechanically maintain adhesion between the heater board 112 and the ceiling plate 113 to form the liquid passages and the common ink chamber. The pressing member 114 is made of, for example, phosphor bronze, spring stainless steel, fiber reinforced plastic (FRP) or the like.

Figure 12:
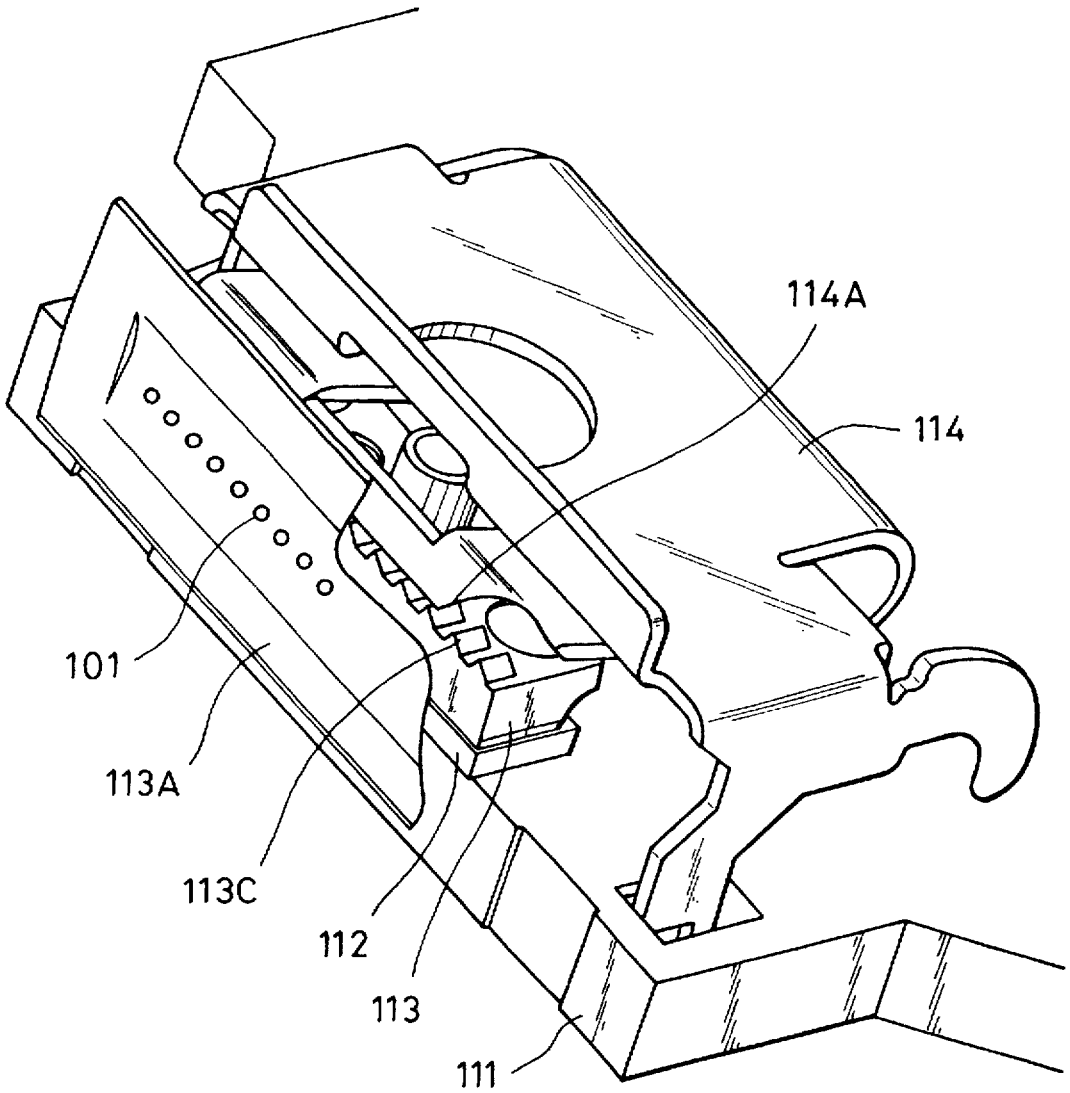
FIG. 12 is a partially cut-away exploded perspective view of an ink jet recording head in accordance with an embodiment of the present invention.

The pressing member 114 has a bent end portion 114A having a high rigidity and extending substantially parallel to a major upper surface of the ceiling plate 113, as shown in FIG. 12. On the other hand, a plurality of projections 113C are formed on the pressing member side of the ceiling plate 113 (opposite from the grooves). The bent end portion 114A of the pressing member 114 presses the projections 113C to maintain the element substrate 112 and the ceiling plate 113 in a combined state. Thus, the pressing force of the pressing member 114 is applied at a plurality of points to disperse variations in the pressing force in the direction along the array of ink ejection ports due to a warp or deformation of the ceiling plate on the pressing member side or variation in the accuracy of finishing the bent end portion 114A of the pressing member 114. Therefore, an entire portion in the vicinity of the ink ejection ports can be pressed by the uniformly distributed pressing force, thus joining the substrate and the ceiling plate firmly and reliably.

In this embodiment, a spring stainless steel is used as the material of the pressing member 114 to generate a force of about 3 kg with respect to a plate thickness of 0.35 mm. However, if the surface of the ceiling plate 113 pressed by the spring pressing member is flat as in the conventional art, the pressing force is concentrated locally due to a warp or deformation of the ceiling plate 113 made of resin or variation in the accuracy of the bent end portion 114A of the pressing member 114, so that it is difficult to uniformly apply the pressing force over the entire region in a direction along the array of ejection ports, as described above. In this embodiment, a plurality of projections 113C elongated in a direction substantially perpendicular to the direction of arrangement of the liquid flow passages are provided along the arrangement of the liquid passages on the portion of the grooved ceiling plate 113 to be brought into abutment against the bent end portion **114*a* of the pressing member 114. In this arrangement, some of the projections 113C of the ceiling plate 113 abut more strongly against the bent end portion 114A of the pressing member than others due to warping or deformation of the ceiling plate 113 or variation in the accuracy of the pressing member 114 to be pressed so that the pressing force is dispersed in a direction along the array of the ink ejection ports through the entire pressed area, thereby enabling the substrate and the ceiling plate to be joined under the more uniform pressing force. Preferably, the pressing position of the bent end portion 114A of the pressing member 114 is such that the bent end portion 114A presses at least a liquid passage region formed by the combination of the element substrate 112 and the ceiling plate 113. More preferably, the bent end portion 114A** presses a region closer to the ink ejection ports and, most preferably, it presses a region forming the ejection ports.

It is most preferable to form a pressing region of the bent end portion 114A of the pressing member 114 by setting a width of the pressing region such that the corresponding pressed region defined along the direction of arrangement of the liquid passages communicating with the ink ejection ports extends through the entire width of the liquid passage arrangement. On the other hand, it is preferable to form the projections 113C provided on the pressed portion of the ceiling plate 113 in such a manner that the projections 113C have smaller portions brought into contact with the pressing member 114 so as be able to collapse to a certain extent, or that the projections 113C are tapered toward their contact ends, as in this embodiment.

There is a need to determine an optimal pitch of the arrangement of the projections 113C according to the number of ink ejection ports and other factors. If the number of projections are increased so that the pitch is excessively small, the force applied to one contact end is so small that the projection 113C does not collapse sufficiently. In such a case, the bent end portion 114A of the pressing member 114 cannot contact the projections 113C through the entire contact region if the ceiling plate 113 has a warp or deformation or if the accuracy of the pressing member 114 varies, resulting in failure to achieve the desired effect. Conversely, if the pitch is excessively large, the ink passages between the projections are not firmly pressed against the element substrate 112, resulting in an inability to stably eject ink.

It has been experimentally confirmed with respect to this embodiment that an optimal result can be obtained if the ratio of ink ejection ports and projections 113C is 12:1.

(Third Embodiment)

Figure 7:
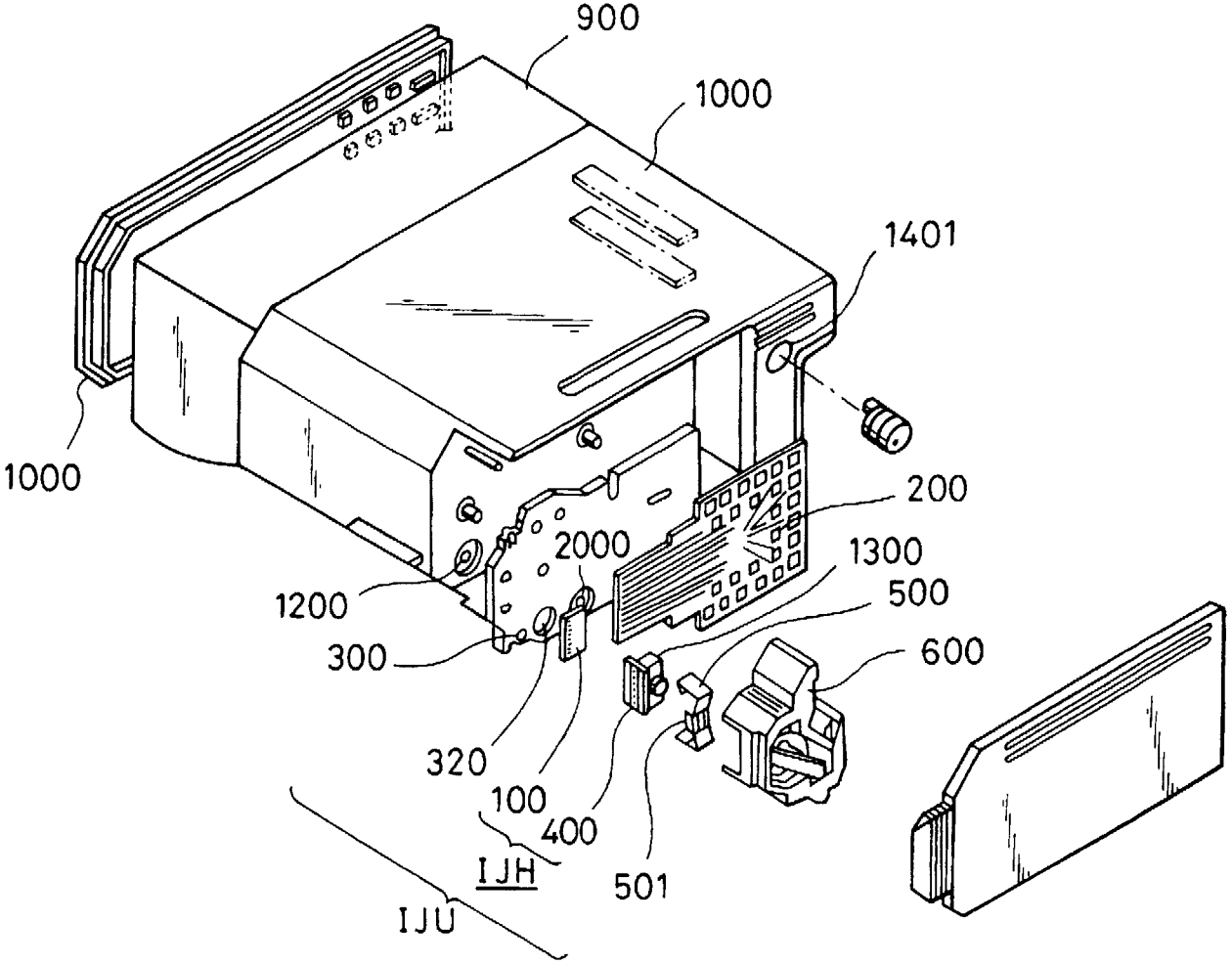
FIG. 7 is an exploded perspective view of an ink cartridge in accordance with the present invention.
Figure 13:
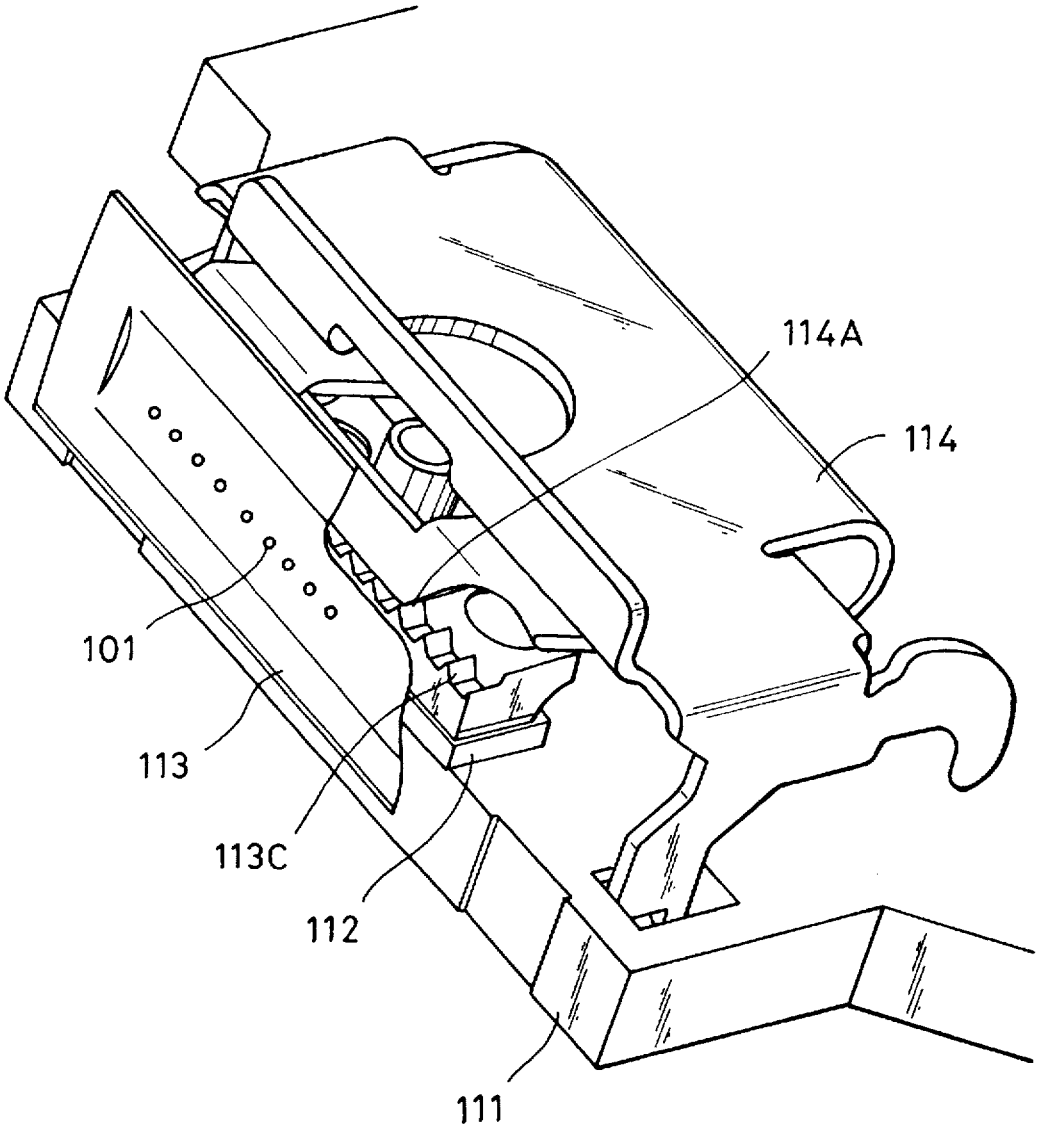
FIG. 13 is a partially cut-away exploded perspective view of an ink jet recording head in accordance with another embodiment of the present invention.

FIG. 13 shows a third embodiment of the present invention. As shown in FIG. 7, the portion of a ceiling plate 113 on which a plurality of projections 113C are provided is reduced in thickness and the projections 113C are formed by being elongated in a direction parallel to the direction in which ink is ejected. The rigidity of the ceiling plate 113 in the direction along the array of ink ejection ports is thereby reduced, so that the ceiling plate 113 can be pressed to achieve uniform adhesion through the entire range along the array of ink ejection ports.

(Fourth Embodiment)

Figure 14:
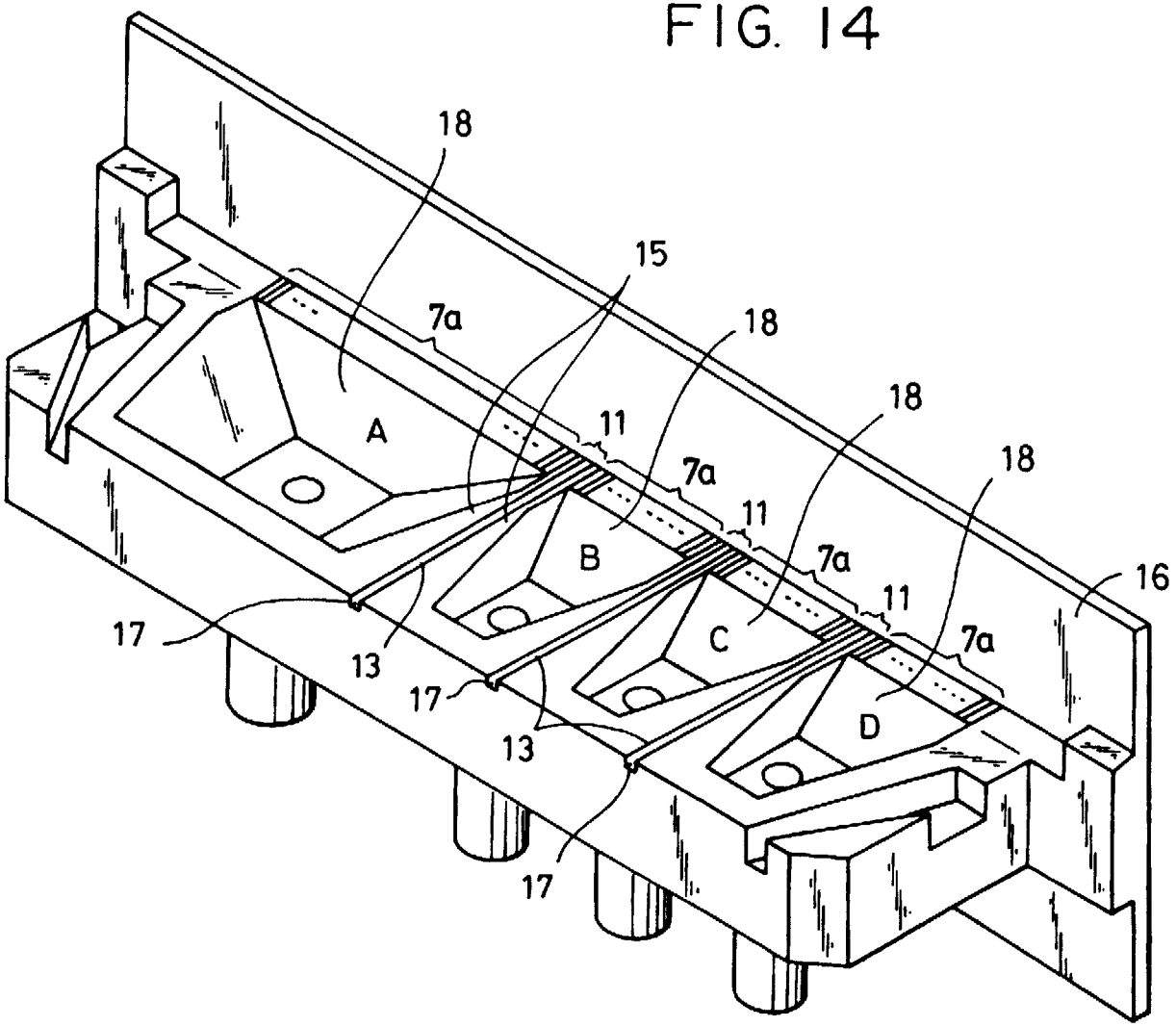
FIG. 14 is a diagram of a grooved ceiling plate in accordance with the present invention.

FIG. 14 shows a grooved member (ceiling plate) in accordance with a fourth embodiment of the present invention. The grooved member shown in FIG. 14 has grooves 10 for forming flow passages, liquid chamber separating grooves (dummy nozzles) 11 for separating groups of flow passages, and common liquid chamber separating grooves 13, walls 15 of the common liquid chamber separating grooves, an orifice plate 16, a plurality of recesses 17 for forming ports through which a sealant is injected into the common liquid chamber separating grooves, and a plurality of recesses A, B, C, and D for forming common liquid chambers. The common liquid chambers are completely separated from each other by the sealant.

Sixty four nozzles extend from the common liquid chamber A and are arranged with a pitch of 71 μm. Twenty four nozzles extend from each of the common liquid chambers B, C, and D and are arranged with a pitch of 71 μm.

Considering the bubble release effect at the time of recovery and the stability of supply of ink to the nozzles, it is preferable to set the height h1 of the common liquid chambers to about 0.1 to 1 mm. Keeping in mind the possibility of a sink mark, a warp or the like at the time of molding, it is suitable to set the height h2 from the adhering surface of the heater board to the upper surface of the ceiling plate to about 1.2 to 1.5 mm. The width h3 of the heater board combined with the ceiling plate of these dimensions is set to about 14 mm to realize a compact integral multicolor head.

Figure 15:
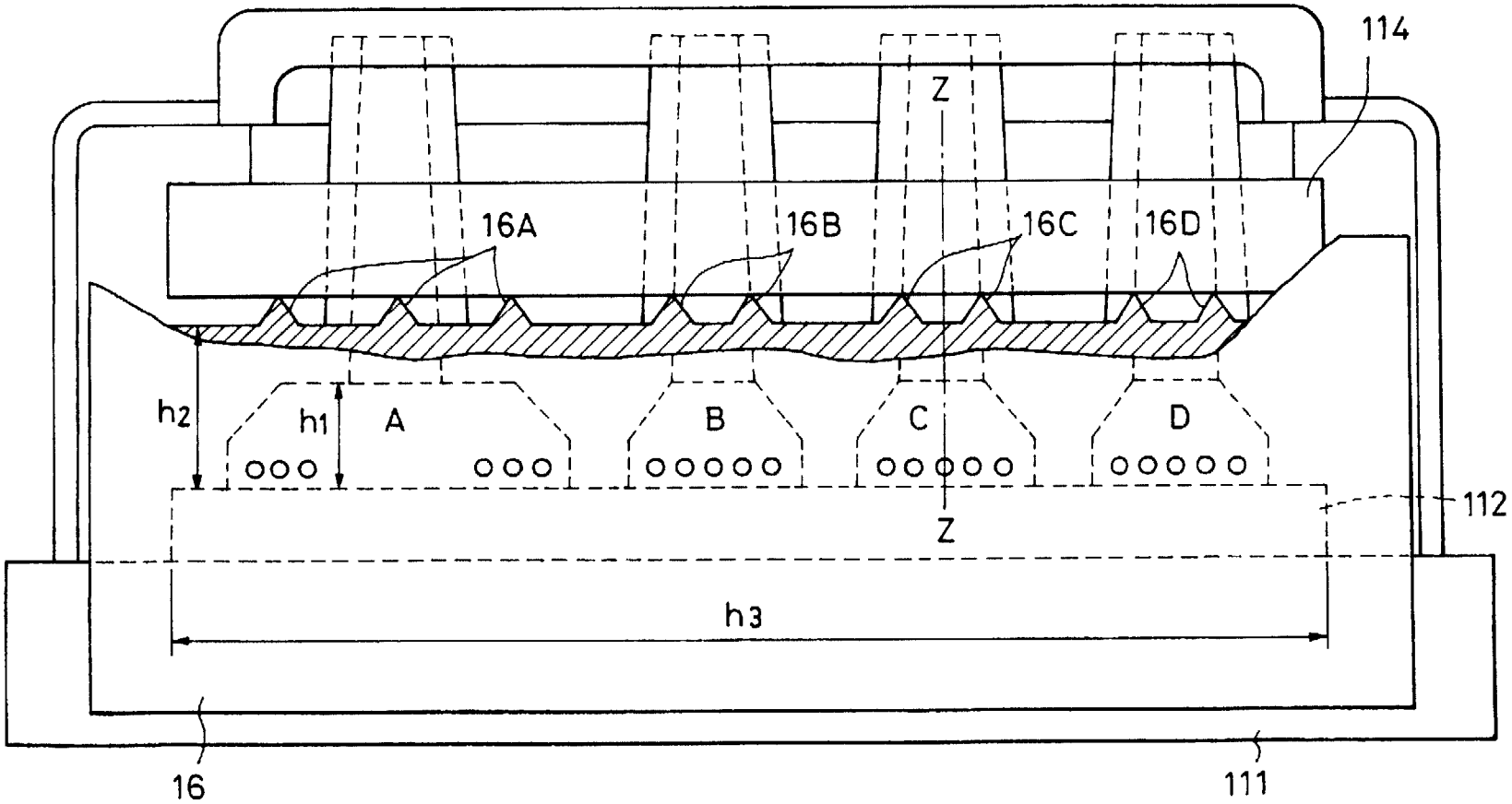
FIG. 15 is a diagram of an ink jet head in accordance with the present invention.

FIG. 15 shows an embodiment of the ink jet head having the plurality of common liquid chambers as shown in FIG. 14. As shown in FIG. 15, a plurality of projections 16A to 16D are provided on a pressed portion of the ceiling plate 16 at positions corresponding to the common liquid chambers and are pressed by a pressing member 114, whereby an effective force is applied to the nozzles of each common liquid chamber so that the adhesion to the heater board 112 is improved.

In this embodiment, a pair of projections are disposed in positions substantially symmetrical about a center line (center plane z—z) intersecting the direction of arrangement of the flow passages and passing through the center of each of the groups of flow passages, thereby enabling the common liquid chambers to be uniformly pressed.

(Fifth Embodiment)

Figure 16:
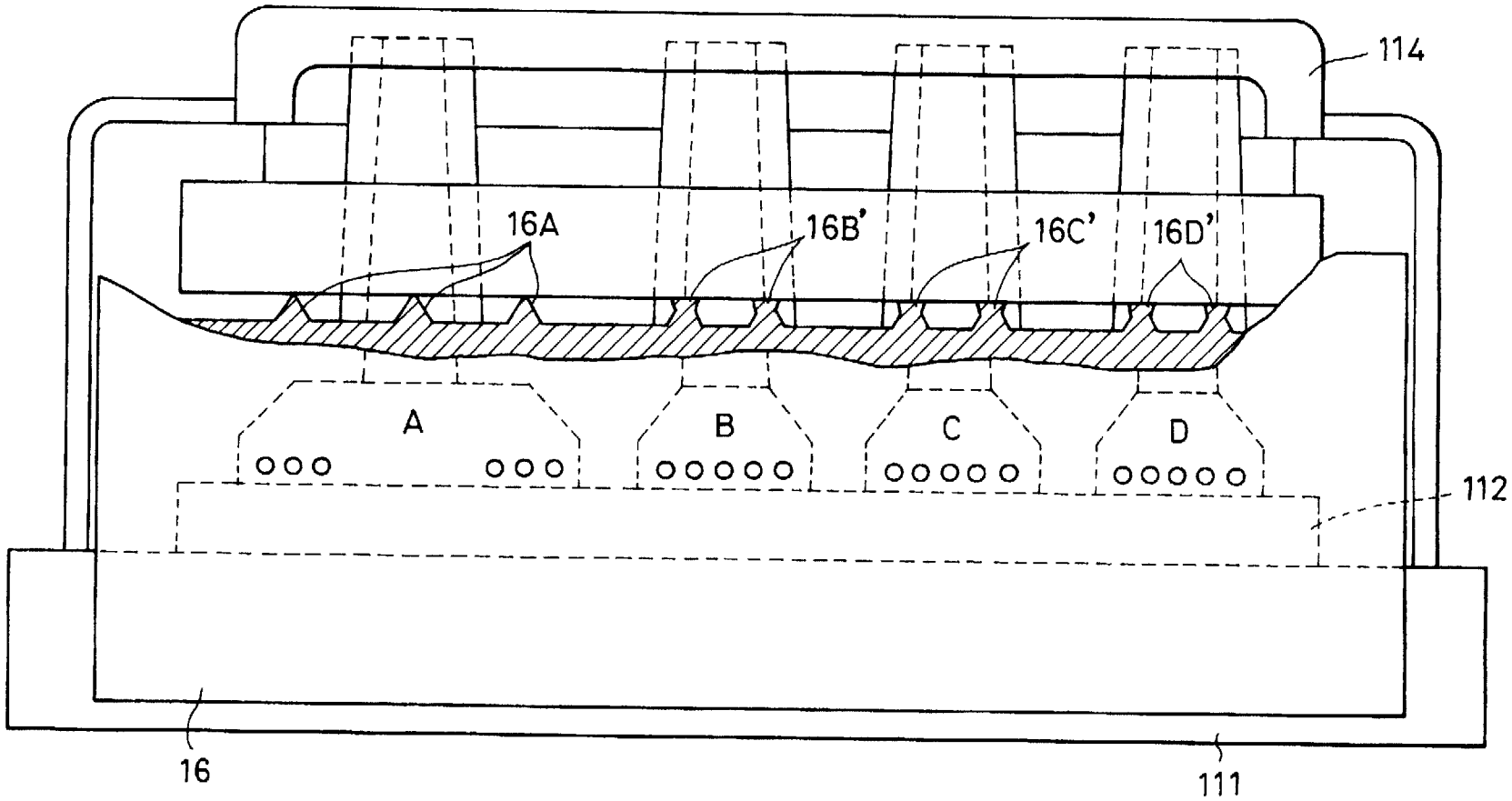
FIG. 16 is a diagram of another ink jet head in accordance with the present invention.

FIG. 16 shows a fourth embodiment of the present invention. In this embodiment, projections 16B', 16C', and 16D' corresponding to liquid chambers having a smaller width in the direction of arrangement of flow passages are formed so as to be higher by 0.01 to 0.1 mm than projection 16A' corresponding to a liquid chamber having a larger width. A force is thereby applied particularly effectively to the nozzles disposed at the positions corresponding to the smaller common liquid chamber width, i.e., a higher rigidity, thereby improving the adhesion.

Description will next be given of an ink jet unit IJU, an ink jet head IJH, an ink jet cartridge IJC, and an ink jet recording apparatus unit IJRA and the construction of these units with reference to FIGS. 7 to 9.

Figure 8:
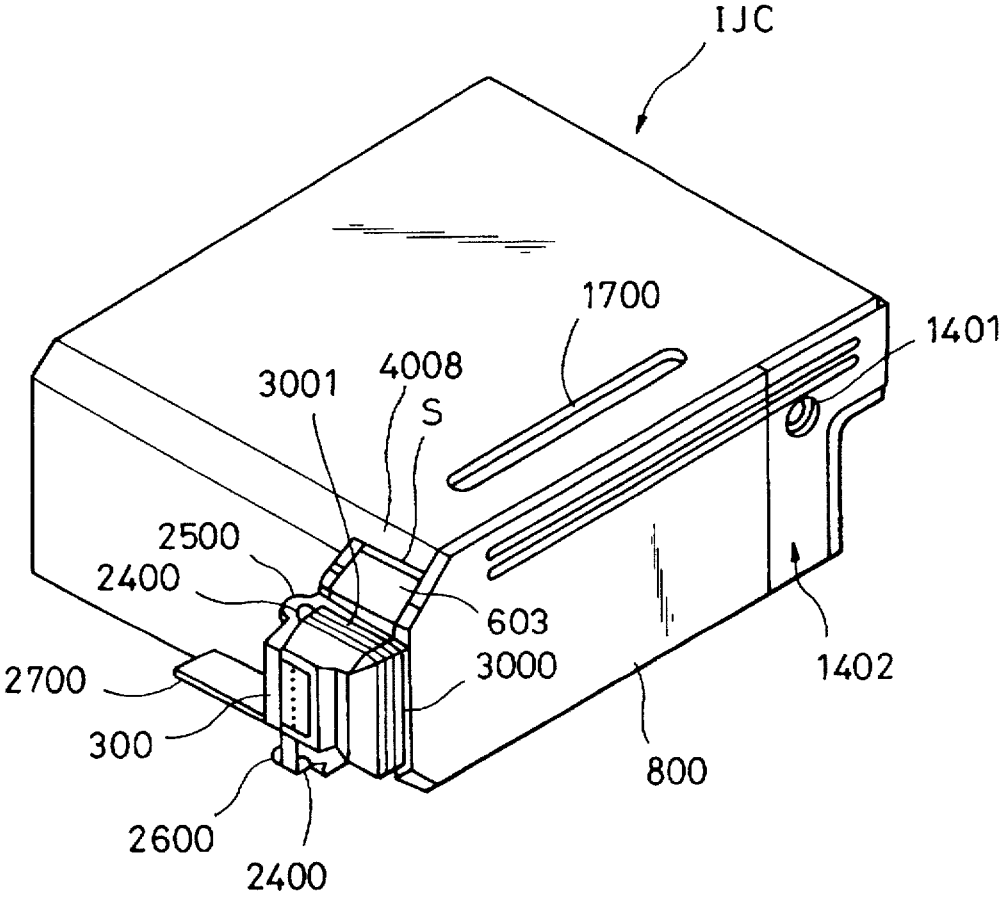
FIG. 8 is a schematic perspective view of the ink cartridge in accordance with the present invention.

This example of ink jet cartridge IJC is formed by integrally combining an ink jet head unit and an ink tank, and the proportion of the accommodation space for the ink tank is larger, as seen in the perspective view of FIG. 8. This ink jet cartridge IJC is a disposable type cartridge which is fixed and supported on positioning means of a carriage and electrical contacts mounted on the ink jet apparatus unit IJRA, and which is detachably attached to the carriage.

The ink jet unit IJU is a bubble jet type unit for recording by using an electrothermal transducer which generates thermal energy for causing film boiling in ink in accordance with an electrical signal.

Referring to FIG. 7, a member 100 is a heater board (first base plate) in which a plurality of electrothermal transducer elements (ejection heaters) arranged in a row and an electric wiring for supplying electric power to the eletrothermal transducer elements are formed on a silicon substrate by a film forming technique. A member 200 is a wiring circuit board connected to the heater board 100.

A member 1300 is a grooved ceiling plate in which partition walls (grooves) for defining a plurality of ink passages and a common liquid chamber for storing ink to be supplied to the ink passages, and on which an orifice plate 400 having a plurality of ejection ports corresponding to the ink passages is integrally formed. As a material for integrally forming these members, a polysulfone resin is preferred but any other molding resin material may alternatively be used.

A metallic supporting member 300 is provided which has a flat surface on which the reverse surface of the wiring circuit board 200 is supported. The supporting member 300 forms a bottom plate of the ink jet unit. A pressing spring 500 provided as a pressing member has an M-like shape and lightly presses the common liquid chamber with slight pressure at the center of the M-like shape and also presses, through a front skirt portion 501, portions of the liquid passages, more preferably regions in the vicinity of the ejection outlets by a pressure concentrated along a linear region. Leg portions of the pressing spring 500 are passed through holes 3121 of the supporting member 300 and are caught on the reverse surface of the supporting member 300 to pinch and join the heater board 100 and the ceiling plate 1300, so that the heater board 100 and the ceiling plate 1300 are tightly pressed and fixed on each other by the concetrated urging force of the front skirt portion 501.

The ink tank is formed of a cartridge body 1000, an ink absorbing member 900 and a lid member 1100 which covers the ink absorbing member 900 in a sealing manner after the ink absorbing member 900 has been inserted into the ink cartridge body 1000 through a side opening opposite from the surface to which the above-described unit IJU is attached. The ink cartridge has a supply port 1200 through which ink is supplied to the unit IJU. A vent air hole 1401 is formed in a lid member for communication between the interior of the cartridge and the atmosphere.

In this embodiment, a synthetic resin such as polysulfone, polyethersulofone, polyphenylene oxide or polypropylene having high resistance to ink is used as the material of the ceiling plate 1300. The ceiling plate 1300 is molded in a mold simultaneously and integrally with the orifice plate 400.

As described above, the ink supply member 600, the ceiling-orifice plate body and the ink tank body 1000 are provided as integrally molded parts. The level of the assembly accuracy is therefore improved. Moreover, this construction is very effective in improving qualities of mass-produced products. Also, the number of components parts is reduced in comparison with the conventional art. It is therefore possible for the unit to stably exhibit improved desired characteristics.

Figure 9:
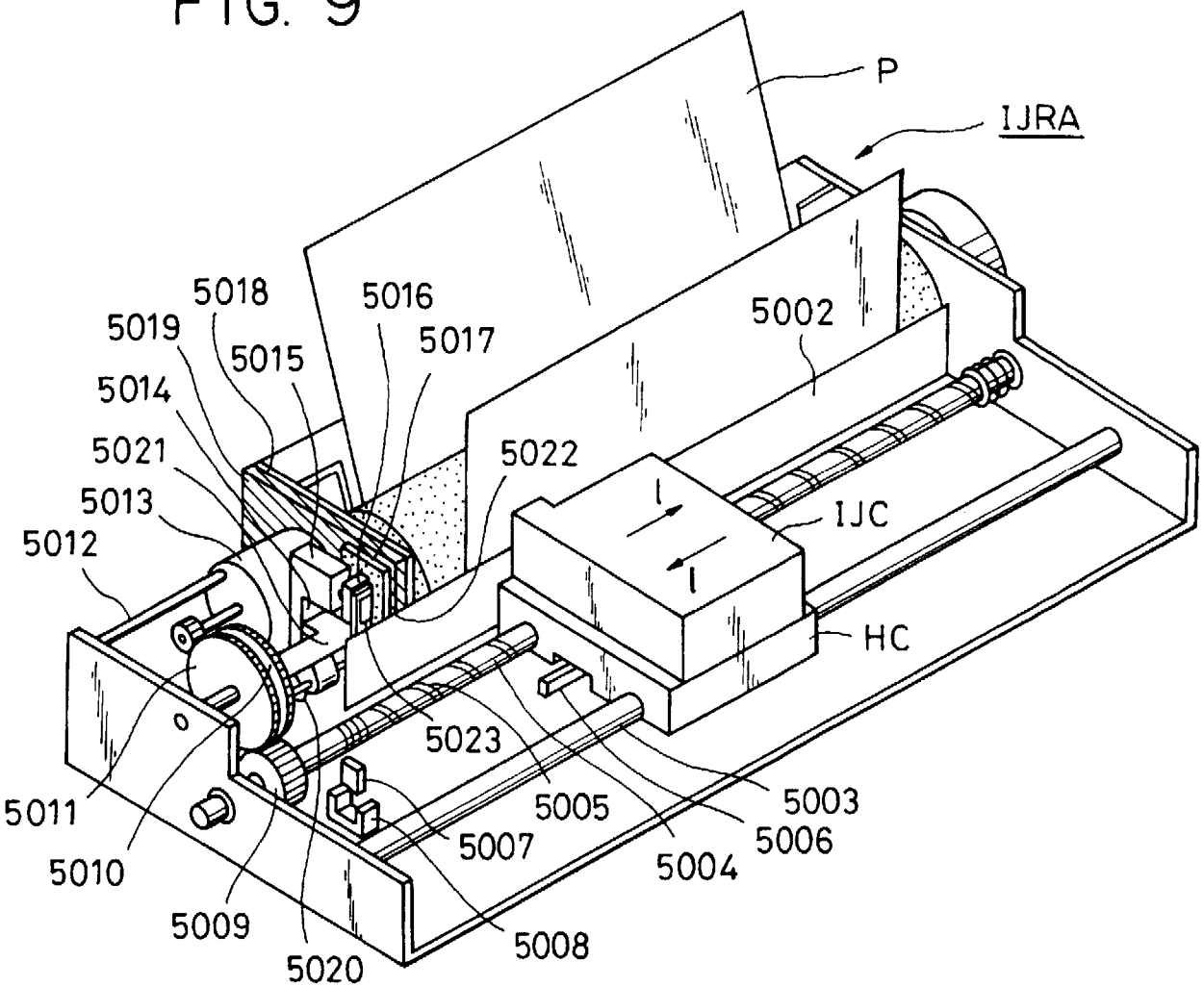
FIG. 9 is a schematic perspective view of an ink jet recording apparatus in accordance with the present invention.
Figure 10:
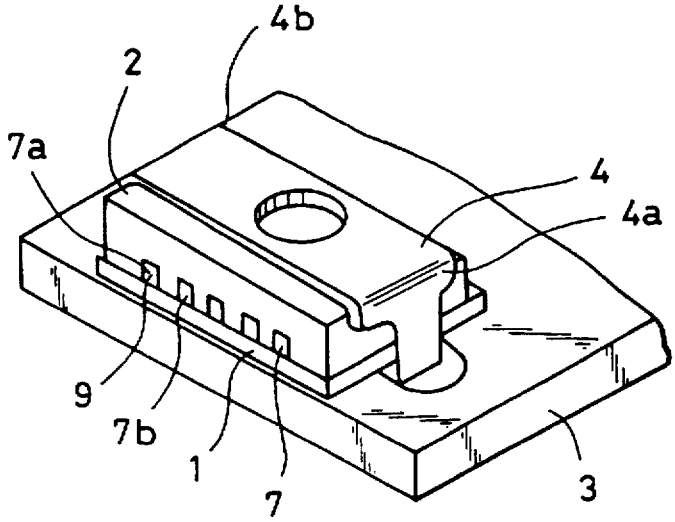
FIG. 10 PRIOR ART
FIG. 10 is a schematic perspective view of a conventional ink jet recording head.
Figure 11A:
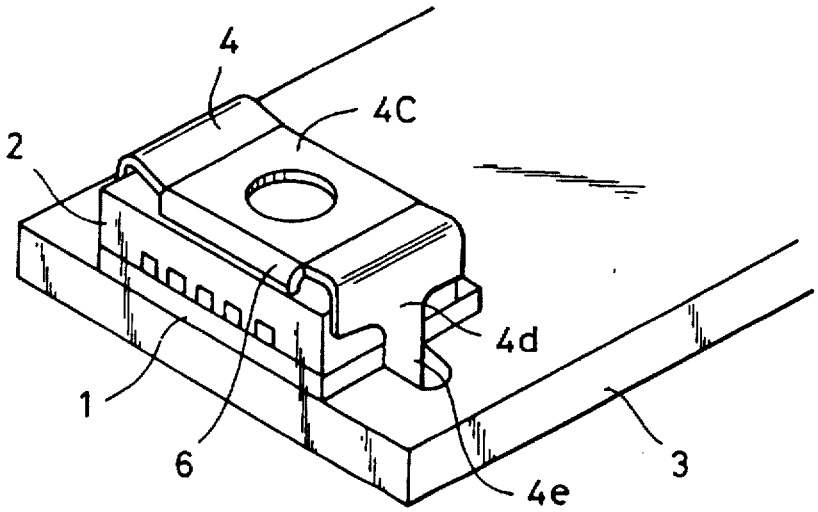
FIG. 11(a) PRIOR ART
FIGS. 11(*a*) and 11(*b*) are schematic perspective views of a conventional ink jet recording head.
Figure 11B:
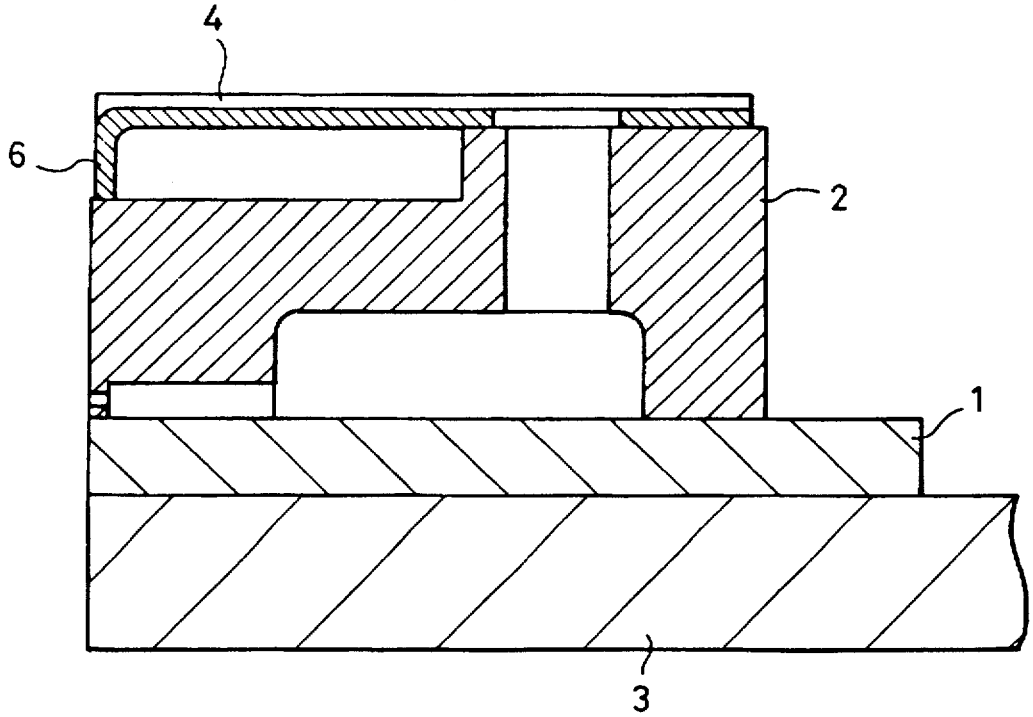
FIG. 11(b) PRIOR ART

FIG. 9 is a schematic perspective view of the external appearance of the ink jet recording apparatus IJRA to which the present invention is applied. A carriage HC, which engages with a helical groove 5004 of a lead screw 5005 rotating by being linked to the rotation of a drive motor 5013 in the normal and reverse directions through driving force transmission gears 5011 and 5009, has a pin (not show) and moves reciprocatingly in the directions of arrows a and b. A paper retaining plate 5002 presses a paper sheet against a platen 5000 through a width along the direction of movement of the carriage. Optical sensor elements 5007 and 5008 are provided as a home position detection means for confirming the existence of a lever 5006 of the carriage in a sensing region to change the direction of rotation of the motor 5013. A member 5016 supports a cap member 5022 for capping a front side of the recording head. A drawing means 5015 for evacuating the interior of the cap is used for drawing recovery of the recording head through an opening 5023 in the cap. A member 5019 enables a cleaning blade 5017 to move along a front-rear direction. The cleaning blade 5017 and the member 5019 are supported on a main body supporting plate 1018. Needless to say, any other well-known cleaning blade can be applied to this apparatus in place of the above-mentioned cleaning blade. A lever 5012 is used to start drawing for drawing recovery. The lever 5012 moves with the movement of a cam 5020 engaging with the carriage to control change-over of the driving force from the drive motor through a well-known transmission means such as a clutch.

For each of the above-mentioned capping, cleaning, drawing recovery, the desired processing can be started at the corresponding position through the operation of the lead screw 5005 when the carriage moves into a region on the home position side. Any of these functions can be applied to this apparatus if the desired operation can be performed by a predetermined timing. The arrangements described above are excellent invented devices in a single form or a combined form, and represent preferred examples in accordance with the present invention.

This apparatus also has a drive signal supply means for driving ejection energy generating elements.

The present invention can be particularly effective when applied to an ink jet head and an ink jet apparatus using a bubble jet system among ink jet recording systems.

For example, as a typical example of such a system, a system based on the fundamental principles described in the specification of U.S. Pat. Nos. 4,723,129 and 4,740,796 is preferably used. This system can be applied to either on-demand type or continuous types of ink jet apparatuses. If this system is applied to the on-demand type, at least one drive signal for causing an abrupt increase in the temperature of a liquid (ink) exceeding a temperature rise causing nucleate boiling in accordance with recording information is applied to an electrothermal transducer facing a sheet or a liquid passage containing the liquid to generate thermal energy in the electrothermal transducer, whereby film boiling is caused in the thermal action surface of the ink jet head. As a result, a bubble can be formed in the liquid (ink) corresponding to the drive signal in a one-to-one relationship. Therefore, an application to an on-demand type of ink jet apparatus is particularly effective. The liquid (ink) is ejected through an ejection opening by the growth and collapse of such a bubble to form at least one liquid droplet. It is preferable to form the drive signal as a pulse-like signal, because a bubble can be instantaneously created and collapsed in a suitable manner so that the response of liquid (ink) ejection is particularly improved. As such a pulse-like drive signals, a drive signal such as those described in the specification of U.S. Pat. No. 4,463,359 or U.S. Pat. No. 4,345,262 are suitable. If the condition of the increase in the temperature of the above-mentioned thermal action surface described in the specification of U.S. Pat. No. 4,343,124 is adopted, the recording performance can be further improved.

Further, the present invention can be applied effectively to a full-line type of ink jet head having a length corresponding to a maximum width of recording medium sheets usable in an ink jet apparatus. Such an ink jet head may be constructed by combining a plurality of ink jet heads so as to have such a length, or may be constructed as one integrally-formed ink jet head.

The structure of the ink jet head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is effectively applicable to the structure disclosed in Japanese Laid-Open Patent Publication No. 123670/1984 wherein a common slit is used as the ejection outlet for plural electrothermal transducers, and to the structure disclosed in Japanese Laid-Open Patent Publication No. 138461/1984 wherein an opening for absorbing pressure waves of the thermal energy is formed corresponding to the ejection portion.

Further, the present invention can be applied effectively to a full-line type of ink jet head having a length corresponding to a maximum width of recording medium sheets usable in an ink jet apparatus. Such an ink jet head may be constructed by combining a plurality of ink jet heads such as those disclosed in the above-mentioned publications so as to have such a length, or may be constructed as one integrally-formed ink jet head.

The present invention can also be applied effectively to an interchangeable chip type of ink jet head which can be electrically connected to the apparatus body and which can be supplied with ink from the apparatus body when mounted in the apparatus body, and a cartridge type of ink jet head integrally combined with an ink tank.

It is preferable to add an ink jet head ejection recovery means, an auxiliary preparatory means and the like as components for the ink jet apparatus of the present invention, because the effect of the present invention can be further stabilized thereby. Such means are, for example, means for capping the ink jet head, a cleaning means, a pressurization or drawing means, a means for preliminary heating using an electrothermal transducer, a heating device different from the transducer or a combination of the transducer and the heating device, and a means for effecting ejection other than that for recording in a preliminary ejection mode. These are also effective in improving the stability of recording.

Further, the present invention is highly effective for an ink jet apparatus having at least one of a recording mode for multi-color recording in two or more colors and a recording mode for full-color recording using mixed colors, regardless of use of one integrally-constructed ink jet head or a combination of a plurality of ink jet heads, as well as for an ink jet apparatus having only a recording mode for recording in a popularly-used color such as black.

While the present invention has been described with respect to what presently are considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet head comprising:

a plurality of ink ejection ports for ejecting an ink;

a plurality of ink passages respectively communicating with said plurality of ink ejection ports;

a plurality of ejection energy generating elements utilized to eject the ink;

a first base member having said plurality of ejection energy generating elements;

a second base member having a bottom surface having a plurality of grooves for forming respectively said plurality of ink passages and a top surface having a plurality of contact portions; and a pressing member for pressing said second base member against said first base member to maintain said first and said second base members in a joined state, said first base member and said second base member being joined to form said ink passages, and said pressing member presses against said plurality of contact portions of said top surface of said second base member.

2. An ink jet head according to claim 1, wherein said plurality of contact portions are provided along a direction of arrangement of said plurality of ink passages.

3. An ink jet head according to claim 2, wherein said pressing member presses a portion of said second base member above said ink passages.

4. An ink jet head according to claim 2, wherein said second base member has at least one recess extending in a direction intersecting the direction of arrangement of said grooves, said recess separating said plurality of contact portions.

5. An ink jet head according to claim 2, wherein said plurality of contact portions are a plurality of projections.

6. An ink jet head according to claim 2, wherein the ink jet head ejects inks having a plurality of colors and has common liquid chambers each communicating with groups of said ink passages separated with respect to the colors.

7. An ink jet head according to claim 6, wherein said plurality of contact portions are a plurality of projections.

8. An ink jet head according to claim 7, wherein said plurality of projections comprises a plurality of projections corresponding to each of the common liquid chambers provided with respect to the colors.

9. An ink jet head according to claim 8, wherein said projections corresponding to each common liquid chamber are disposed substantially symmetrically about a center line which intersects the direction of arrangement of the corresponding one of the groups of ink passages communicating with said common liquid chambers.

10. An ink jet head according to claim 8, wherein at least one of said plurality of common liquid chambers differs in size from the others, and the number of projections corresponding to the larger liquid chamber is smaller than the number of projections corresponding to the smaller liquid chambers.

11. An ink jet head according to claim 8, wherein, when one of the liquid chamber in said plurality of common liquid chambers has a width along the direction of arrangement of said ink passages smaller than that of the others, the height of the projections corresponding to the liquid chamber of the smaller width is larger than the height of the other projections.

12. An ink jet head according to claim 1, wherein said pressing member comprises a spring made of a metal.

13. An ink jet head according to claim 1, wherein said ejection energy generating element is an eletrothermal transducer element.

14. An ink jet head according to claim 1, wherein said second base member is made of a resin.

15. An ink jet head according to claim 14, wherein said resin is polysulfone.

16. An ink jet cartridge comprising:

an ink jet head having a plurality of ink ejection ports for ejecting an ink, a plurality of ink passages respectively communicating with said plurality of ink ejection ports, a plurality of ejection energy generating elements utilized to eject the ink, a first base member having said plurality of ejection energy generating elements, a second base member having a bottom surface having a plurality of grooves for forming respectively said plurality of ink passages and a top surface having a plurality of contact portions, and a pressing member for pressing said second base member against said first base member to maintain said first and said second base members in a joined state, said first base member and said second base member being joined to form said ink passages, and said pressing member presses against said plurality of contact portions of said top surface of said second base member; and an ink tank in which the ink to be supplied to said head is stored.

17. An ink jet apparatus comprising:

an ink jet head having a plurality of ink ejection ports for ejecting an ink, a plurality of ink passages respectively communicating with said plurality of ink ejection ports, a plurality of ejection energy generating elements utilized to eject the ink, a first base member having said plurality of ejection energy generating elements, a second base member having a bottom surface having a plurality of grooves for forming respectively said plurality of ink passages and a top surface having a plurality of contact portions, and a pressing member for pressing said second base member against said first base member to maintain said first and said second base members in a joined state, said first base member and said second base member being joined to form said ink passages, and said pressing member presses against said plurality of contact portions of said top surface of said second base member; and drive signal supplying means for supplying said head with a drive signal for driving said head.

18. An ink jet apparatus comprising:

an ink jet head having a plurality of ink ejection ports for ejecting an ink, a plurality of ink passages respectively communicating with said plurality of ink ejection ports, a plurality of ejection energy generating elements utilized to eject the ink, a first base member having said plurality of ejection energy generating elements, a second base member having a bottom surface having a plurality of grooves for forming respectively said plurality of ink passages and top surface having a plurality of contact portions, and a pressing member for pressing said second base member against said first base member to maintain said first and said second base members in a joined state, said first base member and said second base member being joined to form said ink passages, and said pressing member presses against said plurality of contact portions of said top surface of said second base member; and transport means for transporting a printing medium on which printing is performed with the ink ejected by said head.

* * * * *

UNITED STATES PATENT AND TRADEMARK OFFICE

CERTIFICATE OF CORRECTION

PATENT NO. : 5,784,079

DATED : July 21, 1998

INVENTOR(S): KAZUAKI MASUDA, ET AL.

It is certified that error appears in the above-identified patent and that said Letters Patent is hereby corrected as shown below:

IN THE DRAWINGS

Fig. 2, "COMPATATIVE" should read --COMPARATIVE--.

COLUMN 2

Line 29, "increase the" should read --increase in the--.

COLUMN 4

Line 58, "groove" should be deleted;

Line 59, "depth" should read --groove depth--.

COLUMN 6

Line 21, "as" should read --as to--;

Line 45, "thickness" should read --thickness,--.

COLUMN 8

Line 19, "concetrated" should read --concentrated--;

Line 28, "air" should be deleted;

Line 42, "components" should read --component--;

Line 52, "show)" should read --shown)--.

UNITED STATES PATENT AND TRADEMARK OFFICE

CERTIFICATE OF CORRECTION

PATENT NO. : 5,784,079

DATED : July 21, 1998

INVENTOR(S): KAZUAKI MASUDA, ET AL.

It is certified that error appears in the above-identified patent and that said Letters Patent is hereby corrected as shown below:

COLUMN 9
Line 46, "a drive signal" should read --drive signals--.

COLUMN 11
Line 42, "chamber" should read --chambers--.

Signed and Sealed this

Twenty-seventh Day of April, 1999

*Attest:*

Q. TODD DICKINSON

*Attesting Officer*

*Acting Commissioner of Patents and Trademarks*